United States Patent [19]

Allen

[11] 4,153,397

[45] May 8, 1979

[54] ROTOR DRIVE COUPLING FOR PROGRESSING CAVITY PUMP

[76] Inventor: Clifford H. Allen, 13109 Westchester Trail, Chesterland, Ohio 44026

[21] Appl. No.: 833,740

[22] Filed: Sep. 16, 1977

[51] Int. Cl.[2] ..... F04C 1/06; F01C 1/08

[52] U.S. Cl. ..... 418/48; 64/1 S; 64/2 R

[58] Field of Search ..... 64/2 R, 1 S, 11 F, 13; 418/48, 182, 152

[56] References Cited

U.S. PATENT DOCUMENTS

| | | | |
|---|---|---|---|
| 1,323,850 | 12/1919 | Fisher | 64/13 |
| 2,532,145 | 11/1950 | Byram | 418/182 X |
| 3,498,186 | 3/1970 | Northcutt | 418/152 X |

FOREIGN PATENT DOCUMENTS

| | | | |
|---|---|---|---|
| 2040748 | 2/1972 | Fed. Rep. of Germany | 418/48 |
| 2438222 | 2/1976 | Fed. Rep. of Germany | 418/48 |
| 2529918 | 1/1977 | Fed. Rep. of Germany | 418/152 |

*Primary Examiner*—Carlton R. Croyle

*Assistant Examiner*—Leonard E. Smith

*Attorney, Agent, or Firm*—Bosworth, Sessions & McCoy

[57] ABSTRACT

A stress relief device for a flexible shaft used to connect a rotary drive to a rotary load, wherein the shaft flexes in response to loads that produce bending stresses during shaft rotation. The shaft has a radial flange, or hub, on at least one end for connecting the respective end to another radial flange on either the rotary drive or the rotary load. In order to relieve the joint between the shaft and the hub from the stress concentration that occurs due to flexure of the shaft while being supported in built-in fashion as a cantilever beam, an annular stress relief member is mounted on the shaft inwardly of and tightly secured to the radial flange, or hub. The specially designed stress relief member is tightly positioned around the underlying cylindrical surface portion of the shaft to provide a fixed-end cantilever-type support therefor so that bending stresses occurring due to shaft flexure are more gradually transmitted to and through the stress relief member to avoid stress concentration at the junction of the shaft and the radial flange, or hub.

8 Claims, 5 Drawing Figures

ROTOR DRIVE COUPLING FOR PROGRESSING CAVITY PUMP

BACKGROUND OF THE INVENTION

This invention relates to connections between rotary drives and rotary loads, wherein, due to parallel misalignment between the axes of the drive and load, such as, for example, orbital movement of the load axis during rotation, the drive and the load require a flexible connection. More particularly, the invention relates to a flexible-shaft-type connection between the drive and load that carries bending stresses during operation and especially to a means for isolating the end portions of the shaft at the point where the attachment is made to the rotary drive or rotary load from the stresses that occur due to the bending moment applied to the shaft.

One particular application where such flexible shafts are used is in connection with progressing cavity, positive displacement rotary pumps, such as the pumps described in my U.S. Pat. Nos. 3,512,904 and 3,938,744 (hereinafter referred to as "Allen" devices, or pumps). These pumps have a rotor with an exterior helical surface that engages the surrounding interior helical surface of the stator, the rotor surface having one more thread than the stator surface and a lead twice that of the stator surface. Thus, the stator surface and the rotor surface define therebetween sealed pumping cavities that are axially advanced as the rotor rotates and at the same time orbits in the same direction at two or more times the rate of its rotation. For a more complete description of Allen pumps of this type, reference is made to my aforesaid U.S. Pat. No. 3,512,904.

Another class of rotary helical devices or pumps that utilize flexible coupling shafts to advantage is the class that includes the well-known Moineau-type device as disclosed, for example, in U.S. Pat. No. 1,892,217. Typical examples of the use of flexible shafts for Moineau-type pumps are shown in U.S. Pat. Nos. 2,028,407; 2,456,227; and 3,612,734. The devices shown use metal shafts or metal cables.

More recently, flexible shafts formed of an engineering grade plastic, such as an acetal homopolymer known commercially as "DELRIN", have been used as disclosed in my U.S. Pat. No. 3,938,744. The connection of the flexible shaft to the rotary drive shaft and to the rotor can be accomplished in several ways, one method being, where space permits, radial flanges or hubs. Since it is usually not practical to form the shaft and hubs as an integral unit, it is often desirable to secure the hub or hubs to the shaft by bonding, such as, for example, in the case of engineering grade plastics, by spin welding.

During operation, however, the flexing of the shaft and the sharp change in flexibility at the joint between the shaft and built-in support collar or hub produce concentrated stresses in the shaft at the edge of the joint. This stress concentration in the bonding zone increases the danger of failure during use and shortens the effective life of the shaft.

The device of the present invention, however, reduces the difficulties indicated above and affords other features and advantages heretofore not obtainable.

SUMMARY OF THE INVENTION

It is among the objects of the invention to provide an improved, flexible-shaft-type coupling between a rotary drive and a rotary load wherein the axes of the drive and load are in parallel misalignment during operation.

Still another object is to relieve stresses occurring at the joint between a flexible shaft and a radial flange, or hub, at the end, or ends, of the shaft used to connect the ends of the shaft to a rotary drive or a rotary load, wherein the shaft flexes during operation to cause bending moments that result in stress concentration at the ends of the shaft.

Still another object is to provide an improved, flexible-shaft-type coupling means between a rotary drive and an orbital rotor for a progressing cavity, positive displacement rotary pump.

These and other objects are accomplished by the device of the present invention wherein a novel, flexible shaft assembly is used to connect a rotary drive to a rotary load, the shaft being subject to flexure during operation that results in stress concentrations at the end, or ends, of the shaft. In accordance with the invention, the shaft is provided with a radial hub on at least one end thereof for connecting the respective end to either the rotary drive or the rotary load. In order to relieve the joint between the shaft and the hub from stresses of the type described, an annular stress relief member is mounted on the shaft inwardly of and secured to the radial flange. The stress relief member is tightly positioned around the underlying surface portion of the shaft to provide a fixed-end, cantilever-type support for the shaft, whereby bending stresses occurring due to the bending moment produced by beam-type shaft flexure are transmitted to the stress relief member to reduce stress at the junction of the shaft and the radial flange.

In the preferred form, the shaft is connected at one end to a rotary drive having a fixed axis of rotation and extends through a generally tubular rotor so that a shaft hub at the opposite end is connected to the rotor which is adapted for both rotary and orbital movement.

Also, in the preferred form, the flexible shaft and the hub, or hubs, are formed of an engineering grade plastic and the hub, or hubs, are bonded to the flexible shaft, such as by spin welding. Prior to the bonding operation, the stress relief member is pressed onto the shaft inwardly of its final position prior to the bonding operation. After the bonding operation, the stress relief member is forced axially outwardly on the shaft into engagement with the hub. Then the hub and the stress relief member are tightly secured to one another and also to the drive hub, such as by nuts and bolts.

DESCRIPTION OF THE PREFERRED EMBODIMENT

Figure 1:
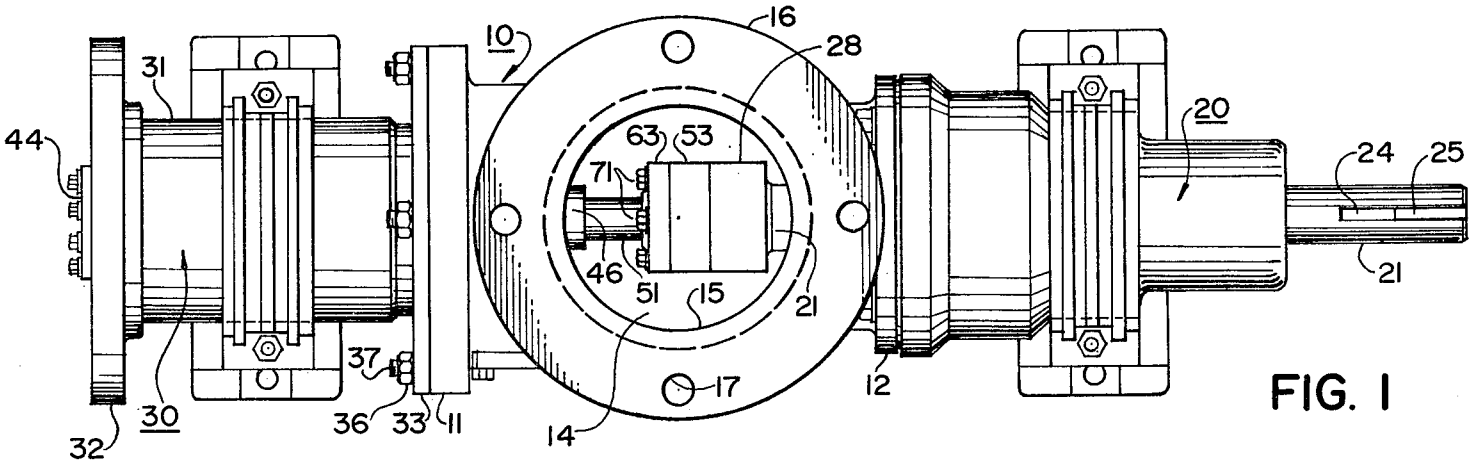
FIG. 1 is a plan view of a progressing-cavity, positive-displacement rotary pump, utilizing the flexible shaft assembly of the invention.

For the purpose of illustration, the invention will be described herein in connection with its use in a progressing cavity Allen-type pump designed for pumping liquid and liquid slurries. The pump is of the larger variety, such as might be used in municipal sewage facilities where high volume output is required. The pump shown and described is capable of pumping 150 gallons per minute at 500 rpm. Liquid is received by the pump through an inlet pipe (not shown) with a suitable flange fitting and is exhausted through an outlet (not shown) connected to the front end of the pump. The pump comprises a main housing assembly 10, a shaft housing assembly 20, a stator assembly 30, a rotor assembly 40, and a coupling shaft assembly 50, embodying the invention.

The main housing assembly 10 has a body in the form of a steel casting with radial flanges 11 and 12 on each end. The radial flange 12 fits against the shaft housing assembly 20 and is secured thereto by bolts 13 to fasten the two housing assemblies 10 and 20 together. The body defines an inlet cavity 14 and an inlet throat 15 communicating with the inlet cavity 14. The inlet throat 15 is defined, in part, by an inlet flange 16 with four symmetrically spaced bolt holes 17, as indicated in FIG. 1, used to secure an inlet pipe to the pump. At the bottom of the inlet cavity 14 is a pipe plug 18 that may be used for draining and cleaning the pump.

Figure 2:
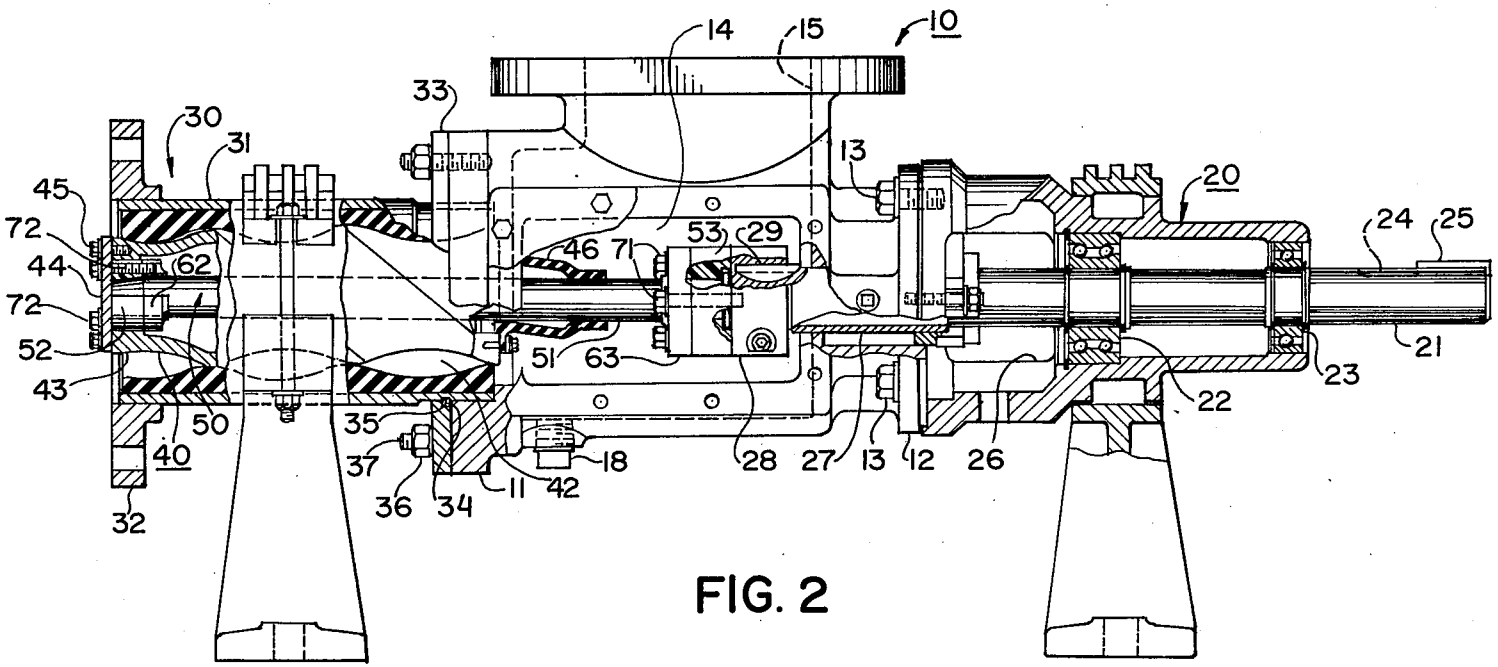
FIG. 2 is an elevational view of the rotary pump of FIG. 1 with parts broken away and shown in section for the purpose of illustration.

The shaft housing assembly 20 also has a body in the form of a steel casting that serves as a bearing mount for a rotary drive shaft 21. The shaft 21 is journaled in a conventional manner in a pair of bearing assemblies 22 and 23, supported in the shaft housing assembly 20, as indicated in FIG. 2. The outer, or rearward end, of the shaft 21 has a key slot 24 that receives a conventional key 25 used to connect the shaft 21 to a power source, such as a diesel engine (not shown) for driving the pump.

The shaft housing assembly 20 has a pair of openings 26 in opposite sides thereof used to facilitate access for cleaning and replacement of a packing gland assembly 27. A drive flange 28 is keyed to the inner end of the rotary drive shaft 21, the drive flange 28 being in the form of a split ring, with a key slot that cooperates with a Woodruff key 29 to key the drive flange 28 to the end of the shaft 21.

A stator assembly 30 with the rotor assembly 40 therein is located at the forward end of the main housing assembly 10. The stator assembly 30 includes a cylindrical casing 31, a radial outer flange 32 secured to the outer end of the cylindrical casing 31, and a radial inner flange 33 that bears against an annular ring 34, seated in an annular groove 35 in the cylindrical casing 31. The radial inner flange 33 thus urges the stator assembly into a position tightly seated against the main housing assembly 10, the flange 33 being secured to the radial flange 11 of the main housing assembly by nuts 36, threaded onto studs 37, which, in turn, are threaded into the radial flange 11.

A generally tubular stator 38, preferably formed of rubber or other resilient material, is bonded into the cylindrical casing 31. The stator 38 may be a molded, unitary element, or may be formed of two molded halves. The interior surface of the stator 38 defines helical threads that cooperate with the rotor in a manner described below.

The rotor assembly 40 includes a rotor 41, preferably formed of cast iron and which is located within the stator 38. The rotor 41 has an exterior helical surface with a generally elliptical form, the helical rotor surface having one more thread (i.e., two threads, in this instance) than the helical stator surface (the stator surface having one thread, in this instance). The helical rotor surface engages and cooperates with the helical stator surface to define sealed pumping cavities 42. Also, the threads of the rotor surface have a lead that is equal to the number of threads in the rotor surface times the lead of the helical surface of the stator 38 divided by the number of threads in the stator surface. As the rotor 41 rotates, its axis translates in an orbit circle about the axis of the rotary drive shaft 21, and the pumping cavities 42 are axially advanced. This function is described in my aforesaid U.S. Pat. No. 3,512,904.

The rotor 41 is of hollow construction and has a wall of generally uniform thickness along most of its axial length. The forward end portion 43 of the rotor 41, however, is considerably thicker and of a more solid construction. A rotor outer end plate 44 that covers the interior space of the rotor 41 is secured to the outer end of the rotor by bolts 45 that extend in an axial direction into threaded openings in the rotor. The inner end of the rotor 41 is sealed relative to the inlet cavity 14 by a rubber boot seal 46, with a radial flange 47 that fits against the end of the rotor 41 and is secured thereto by machine screws 48.

In accordance with the invention, the rotor 41 is coupled to the rotary drive shaft 21 by a coupling shaft assembly 50, the elements of which are molded of a strong engineering grade plastic, such as an acetal homopolymer or copolymer. The coupling shaft assembly includes a flexible cylindrical shaft 51, adapted to flex between its ends as necessary in order to accommodate the orbital movement of the rotor 41 in an orbit circle about the axis of the rotary drive shaft 21. As indicated, the coupling shaft assembly is located generally within the pump rotor 41. The outer and inner ends of the flexible shaft 51 are provided with radial hubs, 52 and 53, respectively, which are tightly bonded to the shaft. A preferred method of bonding the radial hubs 52 and 53 to the shaft 51 comprises forming the opposite ends of the shaft 51 with a conical taper (FIG. 3) and forming the hubs 52 and 53 with an opening have a matching conical taper, as indicated at 56 and 57. Accordingly, the hubs may be bonded to the shafts by spin welding, in accordance with spin welding techniques well-known to those skilled in the art.

As indicated above, the flexing of the shaft during pump operation would result, in the absence of the structure embodying the invention, in bending moments which, together with the means of support, cause a concentration of stress at the ends of the shaft at the zone of the bond between the shaft and the hubs 52 and 53. In order to reduce the stress, there are provided, in accordance with the invention, stress relief hubs 62 and 63 which are tightly seated against the radial hubs 52 and 53 and which are tightly fitted around the underlying surface portions of the shaft 51. The stress relief hubs 62 and 63 are then tightly secured, such as by bolts, to the radial hubs so that the fixed-end-type centilever support is provided by the stress relief hubs 62 and 63, rather than by the radial hubs 52 and 53. The radial hubs 52 and 53 thus are limited to carrying the torsional stress caused by torque applied through the hubs 53 and 52 to the flexible shaft 51 and to the rotor 41, respectively. In the embodiment shown, the stress relief hubs 62 and 63 are provided with axially projecting annular extensions 64 and 65. These are adapted to flex slightly and thus to provide a more gradual distribution of stress in transition between the portions of the shaft 51 where the greatest bending stress occurs and the more rigid portions of the stress relief hubs 62 and 63 beyond the inner ends of annular extensions 64 and 65.

Stress concentration factors as high as 2.5 or higher would occur at the edge of the spin welded joints 56 and 57, whereas, the axially projecting extensions 64 and 65 in hubs 62 and 63 flex slightly and effectively reduce the stress concentration factor to 1.5 or even to 1.2. This reduces the maximum shaft bending stress below the fatigue endurance limit of the material and thus extends the useful life of the flexible shaft 51.

Assembly

Figure 3:
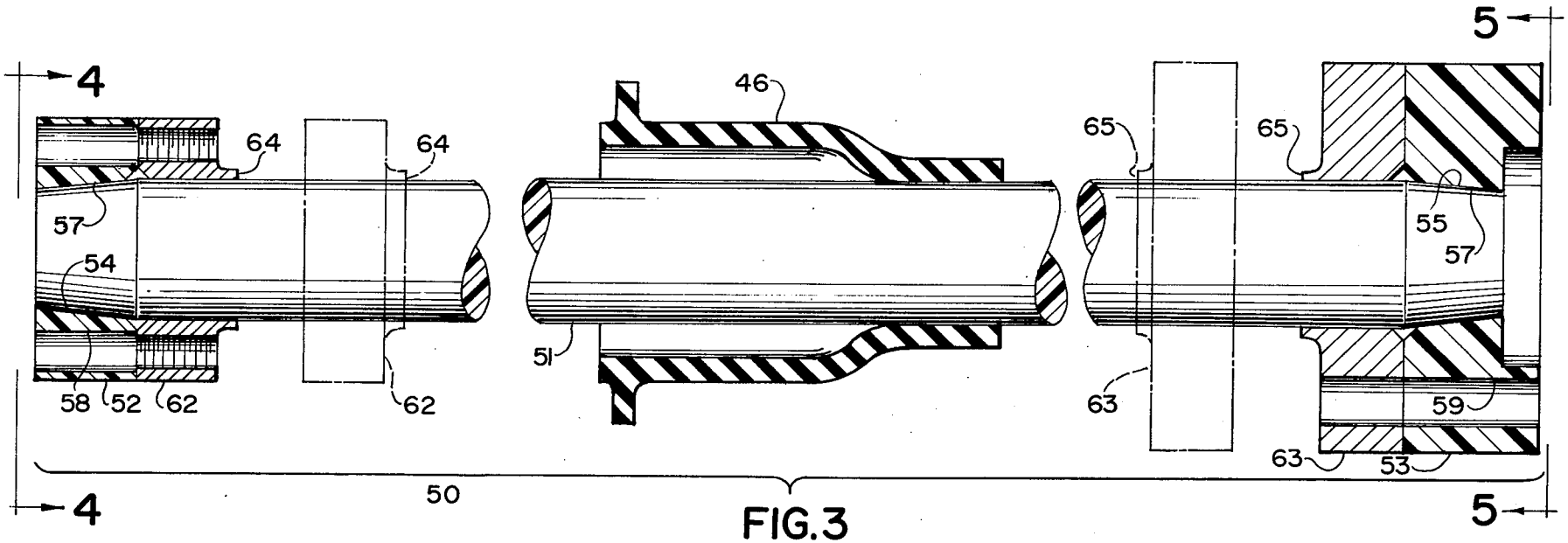
FIG. 3 is a broken sectional view on an enlarged scale of the flexible shaft assembly of the rotary pump of FIGS. 1 and 2 and embodying the present invention.
Figure 5:
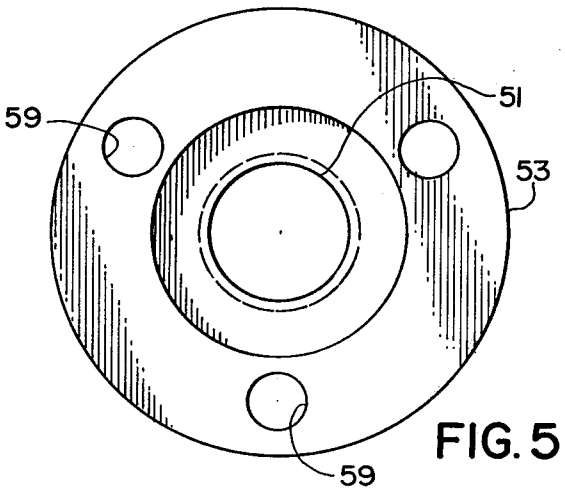
FIG. 5 is a sectional view taken on the line 5—5 of FIG. 3.
Figure 4:
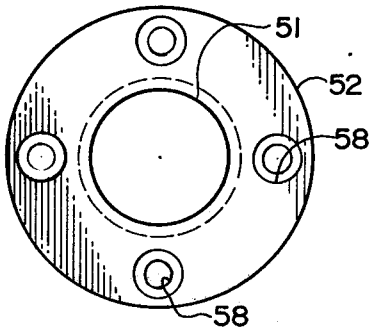
FIG. 4 is a sectional view taken on line 4—4 of FIG. 3.

In the fabrication and assembly of the coupling shaft assembly 50 shown and described herein, it is desirable, after the shaft 51 and hubs 52 and 53 are formed with the respective conically tapered ends and openings, that the stress relief hubs 62 and 63 be pressed onto the flexible shaft 51 to approximately the positions illustrated in dashed lines in FIG. 3.

After the stress relief hubs 62 and 63 are preliminarily positioned on the flexible shaft 51, the radial hubs 52 and 53 are spin welded to tightly bond them to the shaft. The bolt holes 58 and 59 are formed in the radial hubs 52 and 53 before the bonding occurs. It should be noted, also, that no holes are formed initially in the stress relief hubs 62 and 63.

After the spin welding is completed, the stress relief hubs 62 and 63 are pressed axially outward to the positions shown in solid lines in FIG. 3. Then four threaded holes 66 are tapped in the stress relief hub 62 corresponding to the four holes 58 already formed in the radial hub 52 and the matching holes 67 are likewise drilled through the stress relief hub 63 corresponding to the holes 59 in the hub 53.

After this is accomplished, the coupling shaft assembly 50 is bolted to the drive flange 28 on the rotary drive shaft 21 using bolts 71 that extend through both the stress relief hub 63 and the radial hub 53. Then the rotor assembly 40 is placed within the stator 38 and the rotary drive shaft 21 is rotated until the openings in the rotor outer end plate 44 match the openings in the radial hub 52 and the stress relief hub 62. The rotor is then bolted to the coupling shaft assembly using machine screws 72.

After this, the boot seal 46 and flange 47 are bolted to the other end of the rotor 41.

The rotor and stator geometry and the mathematical relationships involved in their operation are described in detail in my U.S. Pat. No. 3,512,904 which is made a part hereof and incorporated by reference herein.

Typical dimensions for the helical positive displacement rotary pump illustrated herein are given in TABLE I below.

TABLE I

| Pump Dimension | (Inches) |
|---|---|
| Eccentricity | .3 |
| Cavity length | 12.2 |
| Rotor major dia. | 4.8 |
| Rotor minor dia. | 3.6 |
| Rotor form length | 16.5 |
| Stator major inside dia. | 5.4 |
| Stator minor inside dia. | 4.2 |
| Stator outside dia. | 6.4 |
| Stator length | 16.0 |
| Stator/cavity length ratio | 1.3 |

In the operation of the pump, shown and described, the drive torque is transmitted from the rotary drive shaft 21 to the rotor 41 through the coupling shaft assembly 50, the flexible shaft 51 flexing sufficiently during the pump operation to accommodate the orbital movement of the rotor. The flexing of the flexible shaft causes bending moments that result in concentration of stresses at the opposite ends thereof. With this construction, however, radial hubs 52 and 53 are relieved of the bending stresses by the stress relief hubs 62 and 63 and there is relatively little danger of failure occurring at the joint where the ends of the shaft 51 are bonded to the radial hubs 52 and 53. Furthermore, the slight flexing of extensions 64 and 65 on stress relief hubs 62 and 63 effectively reduces the stress concentration factor from about 2.5 or higher to 1.5 or even to 1.2.

While the invention has been shown and described with respect to a specific embodiment thereof, this is intended for the purpose of illustration, rather than limitation, and other modifications and variations of the specific embodiment herein shown and described will be apparent to those skilled in the art, all within the intended spirit and scope of the invention. Accordingly, the patent is not to be limited in scope and effect to the specific embodiment herein shown and described, nor in any other way that is inconsistent with the extent to which the progress in the art has been advanced by the invention.

I claim:

1. In a progressing cavity positive displacement rotary pump, including a rotary drive shaft and drive means therefor, a generally tubular stator coaxial with said rotary shaft and having a helically formed interior surface, an orbital rotor received in said stator and having a helically formed exterior surface engaging said interior surface of said stator to define therewith, pumping cavities that progress axially when said rotor is simultaneously rotated and orbited within said stator and a flexible coupling shaft connected between said rotary drive shaft and said rotor and adapted to flex to accommodate orbital movement of said rotor during rotation thereof, the improvement which comprises:

a radial hub located on at least one end of said shaft and bonded thereto for connecting said one end to one of said rotor and said rotary drive shaft and an annular stress relief member on said shaft inwardly of and secured to said radial flange, said stress relief member being tightly positioned around the underlying surface portion of said shaft to provide a fixed-end, cantilever support for said one end of said shaft whereby bending stresses occurring due to the bending moment produced by beam-type shaft flexure are transmitted to said annular members to reduce stress at the region of the bond between said shaft and said radial hub.

2. In a progressing cavity, positive displacement rotary pump, including a rotary drive shaft and drive means therefor, a generally tubular stator coaxial with said rotary shaft and having a helically formed interior surface, an orbital rotor received in said stator and having a helically formed exterior surface engaging said interior surface of said stator to define therewith, pumping cavities that progress axially when said rotor is simultaneously rotated and orbited within said stator and a flexible coupling shaft connected between said rotary drive shaft and said rotor and adapted to flex to accommodate orbital movement of said rotor during rotation thereof, the improvement which comprises:

a radial hub located on at least one end of said shaft for connecting said one end to one of said rotor and said rotary drive shaft and stress relief means on said shaft inwardly of and secured to said hub, said stress relief means comprising an annular member having an axially extending portion tightly positioned around the underlying surface portion of said shaft and adapted to provide a fixed-end support for said shaft, said axially extending portion being adapted to flex resiliently with said flexible shaft to reduce stress concentration in said shaft and thereby to reduce the maximum bending stress in said flexible shaft, whereby bending stress occurring due to the bending moment produced by beam-type shaft flexure are transmitted to said annular member to reduce stress at the juncture of said shaft and said radial hub.

3. In a flexible shaft assembly for connecting a rotary drive to a rotary load wherein said shaft flexes in response to beam-type bending moments that occur during shaft rotation, the improvement which comprises:

a radial hub on at least one end of said shaft for connecting said one end to one of said rotary drive and said rotary load and an annular stress relief member mounted on said shaft inwardly of and secured to said radial hub, said stress relief member having an axial extension tightly positioned around the underlying surface portion of said shaft to provide a fixed-end, cantilever support for said shaft, said axial extension being adapted to flex resiliently with said flexible shaft to reduce stress concentration and thereby reduce the maximum bending stress in said flexible shaft, whereby bending stresses occurring due to the bending moment produced by beam-type shaft flexure are transmitted to said stress relief member to reduce stress at the junction of said shaft and said radial flange.

4. A flexible shaft assembly as defined in claim 3 wherein said radial hub and said annular stress relief member are provided for each end of said shaft.

5. A flexible shaft assembly as defined in claim 3 wherein said flexible shaft and said radial hub are formed of an engineering grade plastic.

6. A flexible shaft assembly as defined in claim 5 wherein said engineering grade plastic comprises an acetal homopolymer.

7. A flexible shaft assembly as defined in claim 5 wherein said radial hub is secured to said shaft by spin welding.

8. A flexible shaft assembly as defined in claim 7 wherein said stress relief member is secured to said radial hub by axially extending fastening means extending through matching openings in said stress relief member and said radial hub.

* * * * *